US007191570B1

(12) United States Patent
Eaton

(10) Patent No.: US 7,191,570 B1
(45) Date of Patent: Mar. 20, 2007

(54) DEFORMABLE BUILDING SHEET BATTEN

(75) Inventor: Peter Francis Eaton, Oatley (AU)

(73) Assignee: James Hardie International Finance B.V. (NL)

( * ) Notice: Subject to any disclaimer, the term of this patent is extended or adjusted under 35 U.S.C. 154(b) by 0 days.

(21) Appl. No.: 09/959,198

(22) PCT Filed: Apr. 14, 2000

(86) PCT No.: PCT/AU00/00320

§ 371 (c)(1),
(2), (4) Date: May 29, 2002

(87) PCT Pub. No.: WO00/63506

PCT Pub. Date: Oct. 26, 2000

(30) Foreign Application Priority Data

Apr. 16, 1999 (AU) ..... PP9803

(51) Int. Cl.
*E04B 2/00* (2006.01)
*E04B 5/00* (2006.01)
*E04B 9/00* (2006.01)

(52) U.S. Cl. ..... 52/506.09; 52/511; 52/489.1; 52/483.1; 52/522; 52/465; 52/800.15

(58) Field of Classification Search ..... 52/506.09, 52/511, 235, 506.08, 506.01, 512, 489.1, 52/483.1, 506.06, 522, 731.1, 731.7, 730.1, 52/169.12, DIG. 3, 450, 465, 800.12, 800.15, 52/800.17
See application file for complete search history.

(56) References Cited

U.S. PATENT DOCUMENTS 1,997,939 A 4/1935 Loucks
3,333,379 A 8/1967 Harris
3,421,281 A 1/1969 Harris
3,606,720 A * 9/1971 Cookson ..... 52/714
3,708,943 A * 1/1973 Thomas et al. ..... 52/309.8
4,063,393 A 12/1977 Toti
4,321,780 A * 3/1982 Hooper et al. ..... 42/461
4,502,256 A * 3/1985 Hahn ..... 52/63
4,779,313 A * 10/1988 Gonas ..... 24/289
D339,642 S * 9/1993 Blazley ..... D25/119
5,557,903 A * 9/1996 Haddock ..... 52/508
5,692,345 A * 12/1997 Mogaki et al. ..... 52/483.1

FOREIGN PATENT DOCUMENTS

| | | |
|---|---|---|
| CH | 368 918 | 4/1963 |
| CH | 678 882 | 11/1991 |
| DE | 26 10 998 | 9/1977 |
| DE | 3210326 | 3/1982 |
| DE | 3232106 | 8/1982 |
| DE | 94 03 018 | 4/1994 |
| FR | 2540160 | 2/1983 |

* cited by examiner

*Primary Examiner*—Naoko Slack
*Assistant Examiner*—Chi Q. Nguyen
(74) *Attorney, Agent, or Firm*—Gardere Wynne Sewell LLP

(57) ABSTRACT

A batten (100) for mounting cladding sheets to a wall or frame, said batten comprising an elongate channel member having a pair of spaced apart side walls (120, 140) joined by an intermediate web (110), and a corresponding pair of mounting flanges (124, 145) spaced outwardly from the web (110) and extending laterally from the side walls (120, 140), adapted for connection to the cladding sheets (300), and the batten (100) being configured such that stress applied to the cladding sheets (300) in use results in preferential deformation of the batten.

63 Claims, 10 Drawing Sheets

DEFORMABLE BUILDING SHEET BATTEN

FIELD OF THE INVENTION

The present invention relates to methods and apparatus for mounting cladding sheets over masonry or steel frame work. The invention has been developed primarily for use with fibre reinforced cement cladding sheets and will be described hereinafter with reference to this application. It will be appreciated, however, that the invention is also applicable to other cladding materials.

BACKGROUND OF THE INVENTION

Battens have previously been used by the applicant in their facade and fascia cladding systems. These battens are sometimes referred to as "top hats" due to their inverted U-shaped cross-section and outwardly splayed edge flanges. The function of these battens or top hats is to provide a planar fixing frame for connection of cladding sheets. As will be appreciated by those skilled in the art, when applying cladding sheets over an uneven surface it is important that the frame on which the cladding sheets are mounted is planar. By the addition of packing materials, and spacers in conjunction with top hat battens, such a planar fixing frame can be obtained.

A known example of a conventional cladding system is shown in FIGS. 1 to 3. FIG. 1 is a front elevational view of a wall 10 covered with a plurality of cladding sheets 11. Each cladding sheet is supported along its longitudinal edges 12 by battens 20. This can be seen more clearly in FIG. 2 which is a cross sectional view through a batten interconnecting two adjacent sheets 11. Each batten is formed by a channel member having a pair of side walls 23 adapted for connection to the frame or wall, to be concealed by means of mounting screws 26 extending through edge flanges 27. An intermediate web 28 forms a platform spaced outwardly from the wall, to support the cladding sheets which are secured by screws 29. The web 28 is of sufficient width to extends across the joint 30 between the two sheets 11. The battens 20 are generally spaced apart to suit the wind loading on the cladding sheets. If required, additional intermediate battens 21 (as shown in FIGS. 1 and 3) may be provided.

The applicants have found that such top hat batten sections allow the main structural framing elements of the wall 10 to be spaced further apart, with the top hat battens spanning the structural elements to provide fixing points for the cladding sheets. It will be appreciated that this provides a substantial cost saving with regard to both the materials and labour required for framing.

Conventional top hat battens, however, have several drawbacks. Firstly, the generally require gaskets 31, backing strips 32 and sealants to provide adequate weatherproofing of the cladding system. Apart from the additional cost associated with such gaskets and backing strips, poor installation techniques may result in misalignment of the cladding sheets and damage to the sheets from over stressing along their edges, as well as inadequate waterproofing. The process is also labour intensive.

Additionally, the generally narrow width of the platform section 28 of the top hat battens requires fasteners to be located close to the sheet edges, as shown in FIG. 2. If such fasteners are located even a few millimetres closer to the sheet edge or if the sheets are not fastened correctly, failure or "break out" of a sheet edge along the line of the fasteners can occur.

Lastly, in use it will be appreciated that stresses can be applied to the cladding sheet either internally or externally which can compromise the strength, weatherproofing or durability of conventional cladding systems. For example, external stress may be applied to a cladding sheet by wind loading or by thermal expansion or contraction of the sub-frame or battens themselves. Internal stresses may arise, for example, from within the fibre reinforced sheet due to moisture movement, carbonation shrinkage etc. In either case, such stresses can lead to premature wear, leakage, or even failure of various elements in the system.

The present invention seeks to overcome or substantially ameliorate one or more of these disadvantages of the prior art, or at least to provide a useful alternative.

DISCLOSURE OF THE INVENTION

In a broad aspect, the present invention provides a batten for mounting cladding sheets to a wall or frame, said batten comprising an elongate channel member having a pair of spaced apart side walls joined by an intermediate web, and a corresponding pair of mounting flanges spaced outwardly from the web and extending laterally from the side walls, the web being adapted for connection to the wall or frame, the flanges being adapted for connection to the cladding sheets, and the batten being configured such that stress applied to the cladding sheets in use results in preferential deformation of the batten.

The deformation is preferably elastic in mode, but may alternatively be plastic or a combination of both elastic and plastic deformation. The force required to displace one of the side walls of the batten, is preferably less than that which would normally induce failure in the cladding sheets due to expected movement or contraction as a result of changes in moisture content. In the preferred embodiment, the battens are configured such that the side walls flex by a predetermined amount, depending upon the stresses likely to be applied by corresponding cladding sheets of preselected size, thickness, material composition, moisture content and other specific characteristics. In this way, the battens can be individually tailored to the cladding sheets and their specific application.

Preferably, the channel member is generally U, omega (Ω) or V-shaped. Preferably, the side walls diverge outwardly from the web toward the mounting flanges, but in other embodiments may alternatively be generally parallel or converge inwardly. The side walls may optionally also be perforated or defined intermittently by spaced apart arms, tabs, fingers or lugs.

In the preferred embodiment, the present invention further provides a sealing strip which, in use, closes the open channel portion of the batten, intermediate the side walls. Also, in the preferred embodiment, the cladding sheets are connected to the mounting flanges by means of discrete fastening elements, ideally in the form of self-tapping screws.

Preferably, the mounting flanges are formed with respective longitudinally extending recessed channels configured, in use, to provide a clearance space between the cladding sheets and the mounting flanges. By extending through this clearance space, the mounting screws are preferably disposed to accommodate a limited degree of pivotal movement, thereby permitting a limited degree of relative lateral displacement in two dimensions between the cladding sheet and the batten, in the plane of the sheet. The recessed channels advantageously also facilitate drainage and thereby help to prevent ingress of water in adverse weather conditions.

According to a second aspect, the invention provides a method for mounting cladding sheets to a wall or frame using battens as previously defined, said method including the steps of positioning a plurality of said battens in spaced apart generally parallel relationship by fastening the web of each batten to the wall or frame, and securing the longitudinal edges of each cladding sheet to the respective mounting flanges of selected battens, such that stress applied to the cladding sheets results in preferential deformation of one or more of the battens.

In the preferred embodiment, the battens positioned between the outer edges of the sheets are adapted to be used in a reverse orientation, to provide intermediate internal support for the sheets. In this reverse orientation, the flanges are preferably connected to the frame or wall, and the cladding sheet is connected to the web.

The web preferably also includes a longitudinally extending recessed channel, configured to the normal orientation to provide a clearance space between the wall or frame and the web, and in the reverse orientation between the cladding sheet and the web. This arrangement allows pivotal movement of the mounting screws extending into the web, in the manner previously described, to permit a limited degree of relative lateral displacement in two dimensions, between the cladding sheet and the batten in the reverse orientation, or between the wall or frame and the batten in the normal orientation. Independently of the relative displacement accommodated by flexural deformation of the side walls.

According to a third aspect, the invention provides a batten for mounting cladding sheets to a wall or frame, said batten comprising an elongate channel member having a pair of spaced apart side walls joined by an intermediate web, and a pair of mounting flanges spaced outwardly from the web and extending laterally from the side walls, the web being adapted for connection too the wall or frame, and the flanges being adapted for connection to the cladding sheets by fastening elements, wherein at least one of the flanges includes a longitudinally extending recessed channel configured, in use, to provide a clearance space between the cladding sheet and the mounting flange such that a limited degree of relative lateral displacement in two dimensions between the cladding sheet and the batten is accommodated by pivotal movement of the fastening elements.

Preferably, both of the flanges include respective longitudinally extending recessed channels, and the fastening elements are preferably screws.

In the preferred embodiment, the web of the batten also includes a longitudinally extending recessed channel configured, in an analogous manner, to permit a limited degree of lateral displacement in two dimensions between the batten and the wall or frame in the normal orientation, or between the batten and the cladding sheets in the reverse orientation, by pivotal movement of the respective mounting screws.

Unless the context clearly requires otherwise, throughout the description and the claims, the words 'comprise', 'comprising', and the like are to be construed in an inclusive sense as opposed to an exclusive or exhaustive sense: that is to say, in the sense of "including, but not limited to".

BRIEF DESCRIPTION OF THE DRAWINGS

A preferred embodiment of the invention will now be described, by way of example only, with reference to the accompanying drawings in which.

PREFERRED EMBODIMENT OF THE INVENTION

Figure 4:
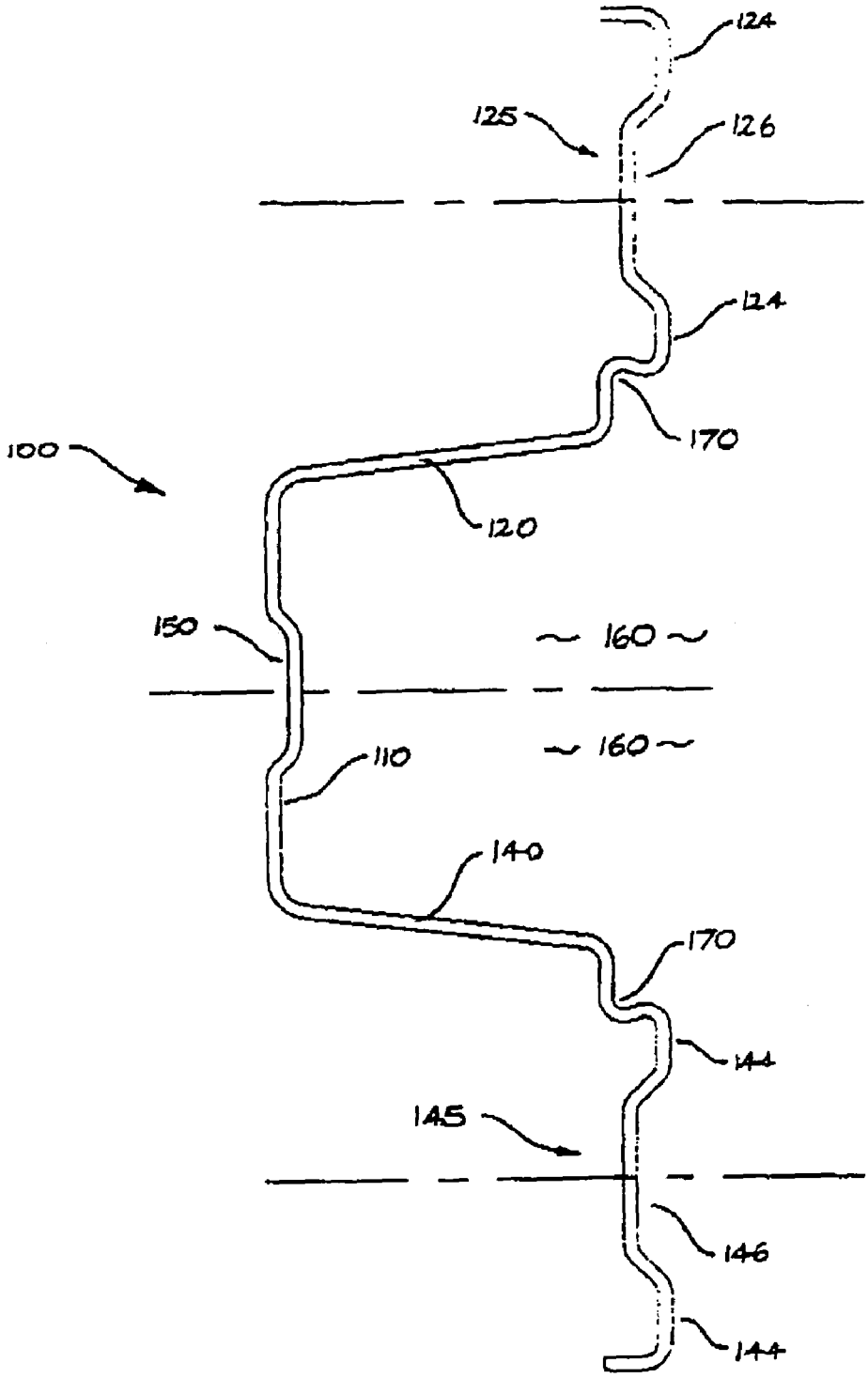
FIG. 4 is a cross sectional view of the top hat batten according to a first embodiment of the present invention.

Referring firstly to FIG. 4, the batten 100 according to the present invention is comprised of a generally U-shaped channel member having arms or side walls 120 and 140 connected by an intermediate web 110.

The side walls diverge outwardly from the web, and terminate in corresponding flanges 125 and 145 extending laterally from their free edges. These flanges are adapted for connection to the cladding sheets as described below. In other embodiments, the side walls may be generally parallel, convergent, curved, V-shaped, omega (Ω) shaped, or be formed with any other suitable profile.

Figure 5:
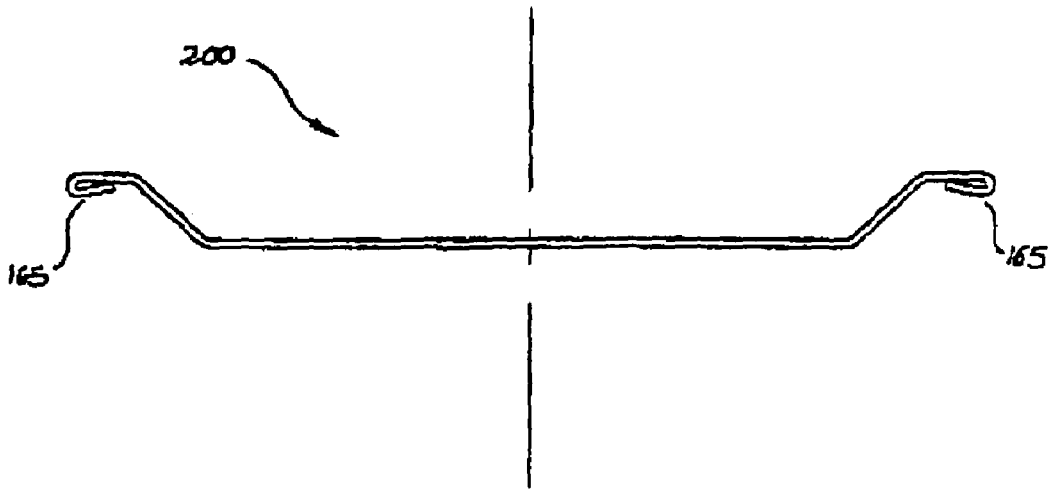
FIG. 5 is a cross sectional view through a sealing strip for use with the top hat batten in FIG. 4.

A detachable sealing strip 200, as shown in FIG. 5, is adapted to extend across and close the open section 160 of the channel, with longitudinal edges 165 captively and sealingly retained within respective mutually opposing groove 170. Appropriate installation of this weather sealing strip 200 is shown in FIG. 6.

Figure 1:
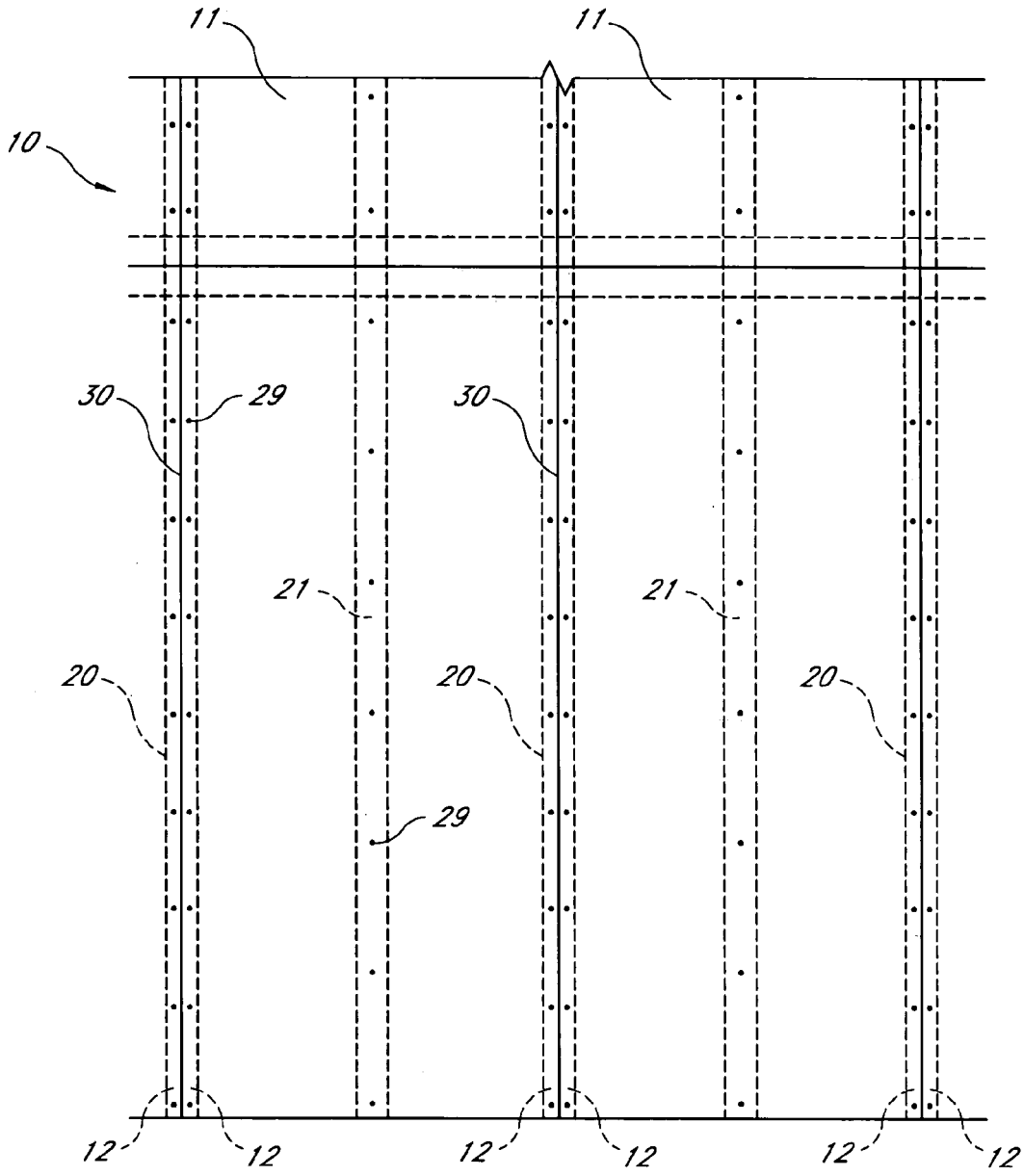
FIG. 1 (PRIOR ART)
FIGS. 1–3 are front elevational and cross sectional views of a conventional cladding system according to the prior art.
Figure 3:
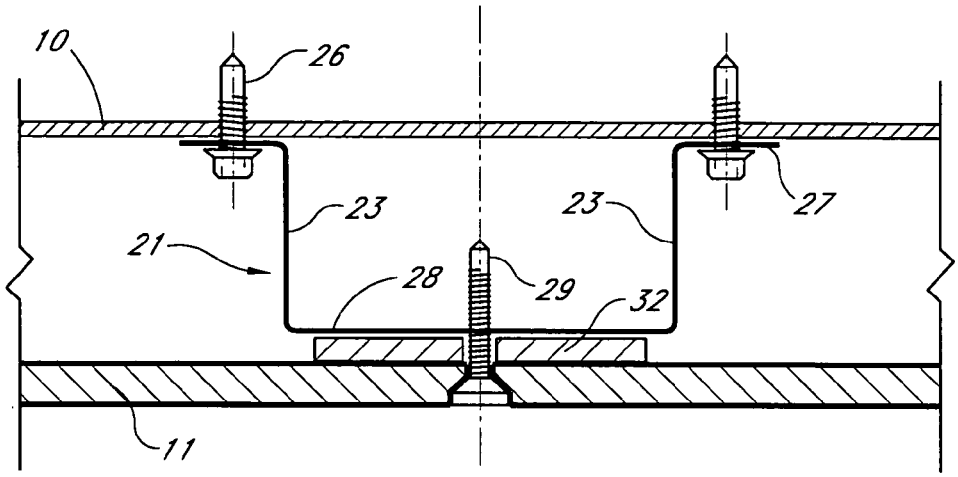
FIG. 3 (PRIOR ART)
Figure 6:
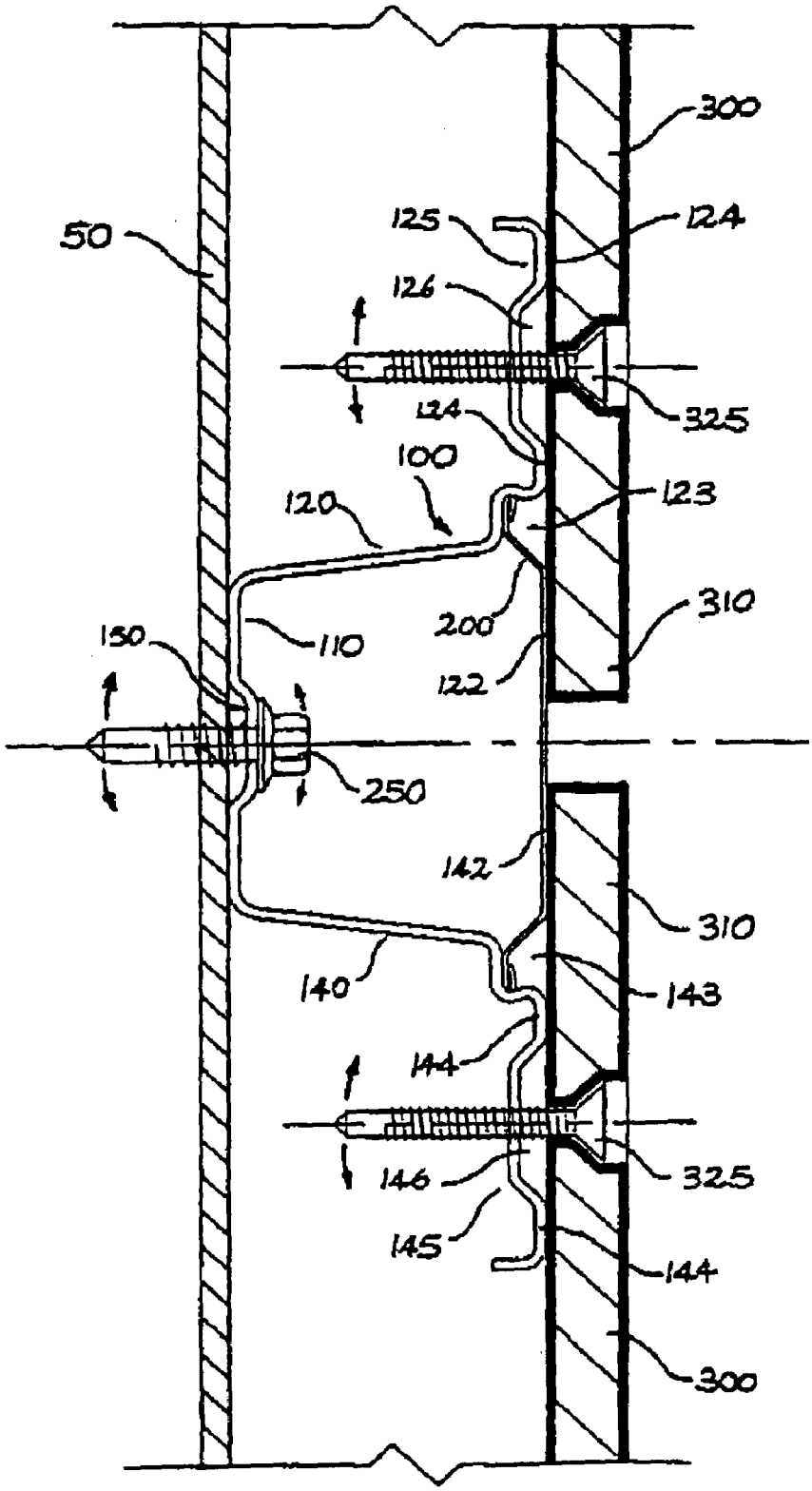
FIG. 6 is an enlarged cross sectional view showing the top hat batten of FIG. 4 and sealing strip of FIG. 5 in situ.

FIG. 6 also shows the installation of the batten 100. The intermediate web portion 110 is first connected to a wall or sub-frame 50, to be concealed. It should be noted that this can be accomplished by a single line of fasteners 250, as distinct from the dual lines of spaced apart fasteners, required by the prior art (see FIGS. 1 to 3). Substantial cost and time savings result from this aspect alone. The outwardly extending side walls 120 and 140 with their respective flanges 125 and 145 are thereby positioned to support the cladding sheets 300. The longitudinal edges 310 of each cladding sheet are secured by corresponding rows of fastening screws 325.

Figure 7:
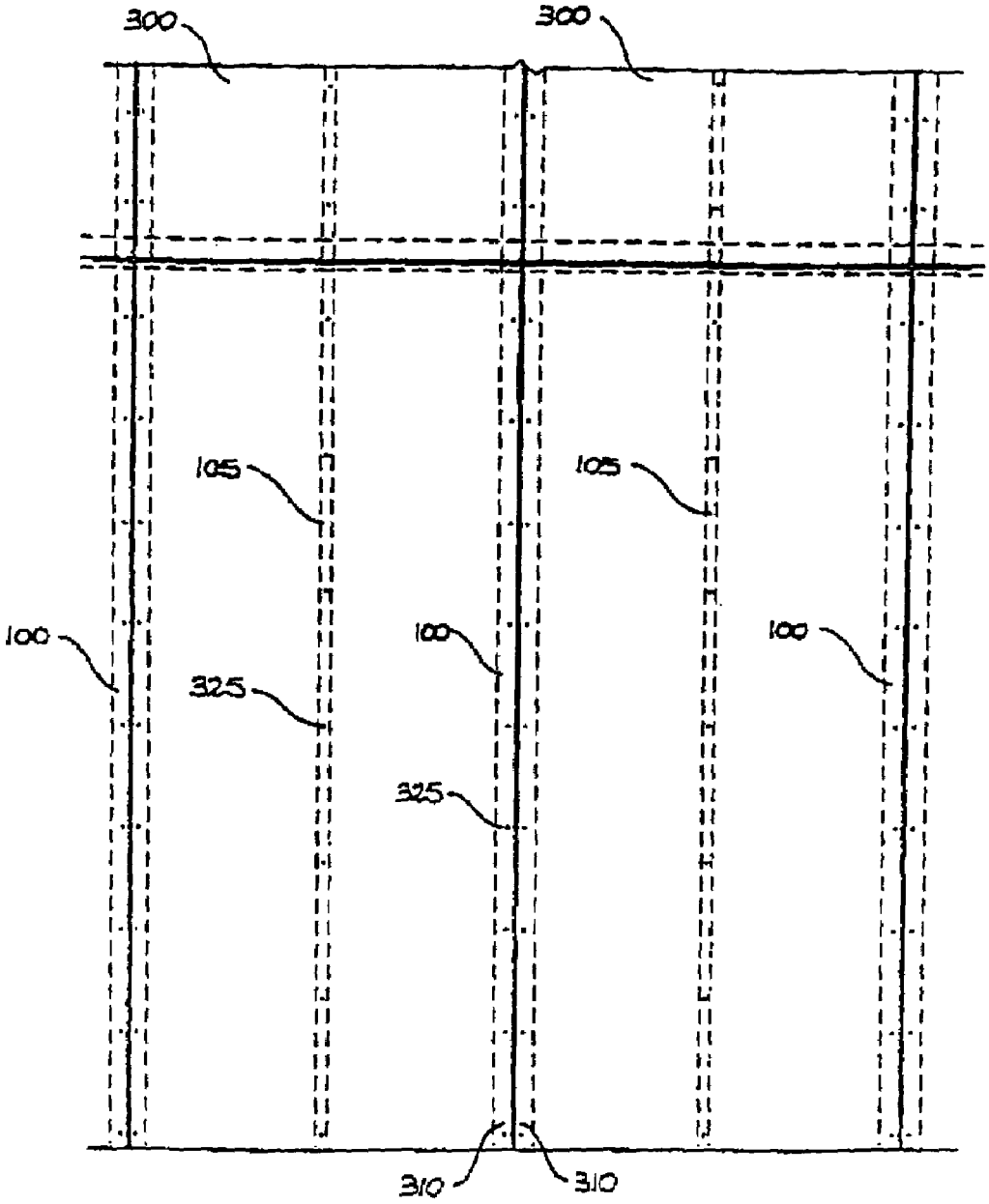
FIG. 7 is a front elevational view of the cladding sheet mounting system according to the present invention.

As shown more clearly in FIG. 7, the spacing and orientation of the battens is based on the intended layout of the sheet joints. Thus, a batten is used to extend between and to support adjacent cladding sheets 300 at each sheet joint. Conventionally, the battens and sheets will extend in the vertical direction along the wall to be clad. It is possible, however, that either or both of the battens 100 and sheets 300 may be oriented in other directions such as horizontally or at intermediate inclinations.

As shown in FIG. 7, intermediate battens 105 may also be used. Battens 105 are the same as the battens 100 shown in FIGS. 4 to 6, but are conveniently installed in the reverse orientation to support the internal areas of the sheets. The arrangement of these intermediate battens is shown in more detail in FIG. 8. In this instance, the web 110 is connected directly to an internal area of the associated cladding sheet 300, with the side walls 120 and 140 being connected to the frame or wall by means of the laterally extending mounting flanges 125 and 145.

Figure 10:
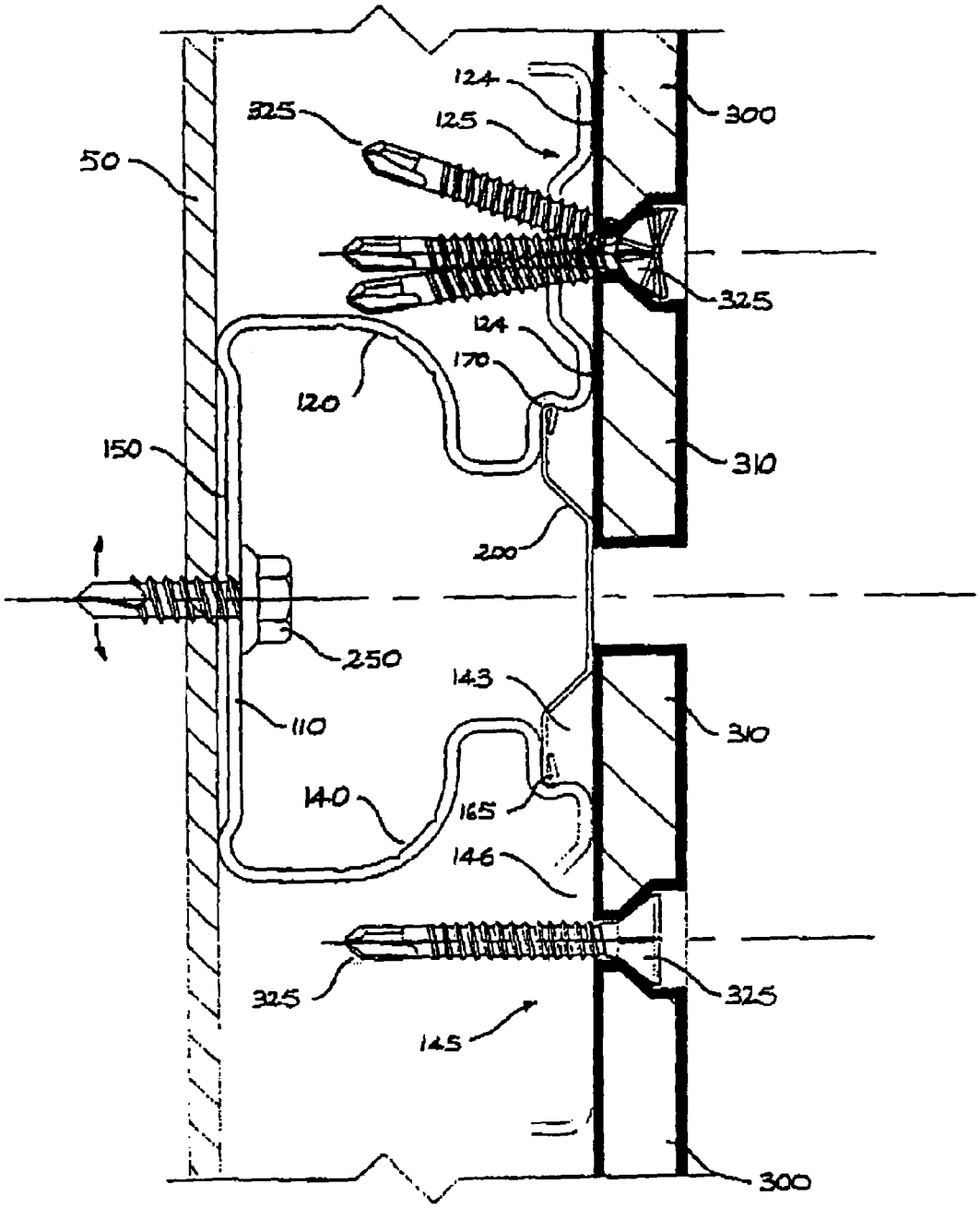
FIG. 10 is a cross sectional view similar to FIG. 6, showing an alternative embodiment of a top hat batten according to the invention.
Figure 11:
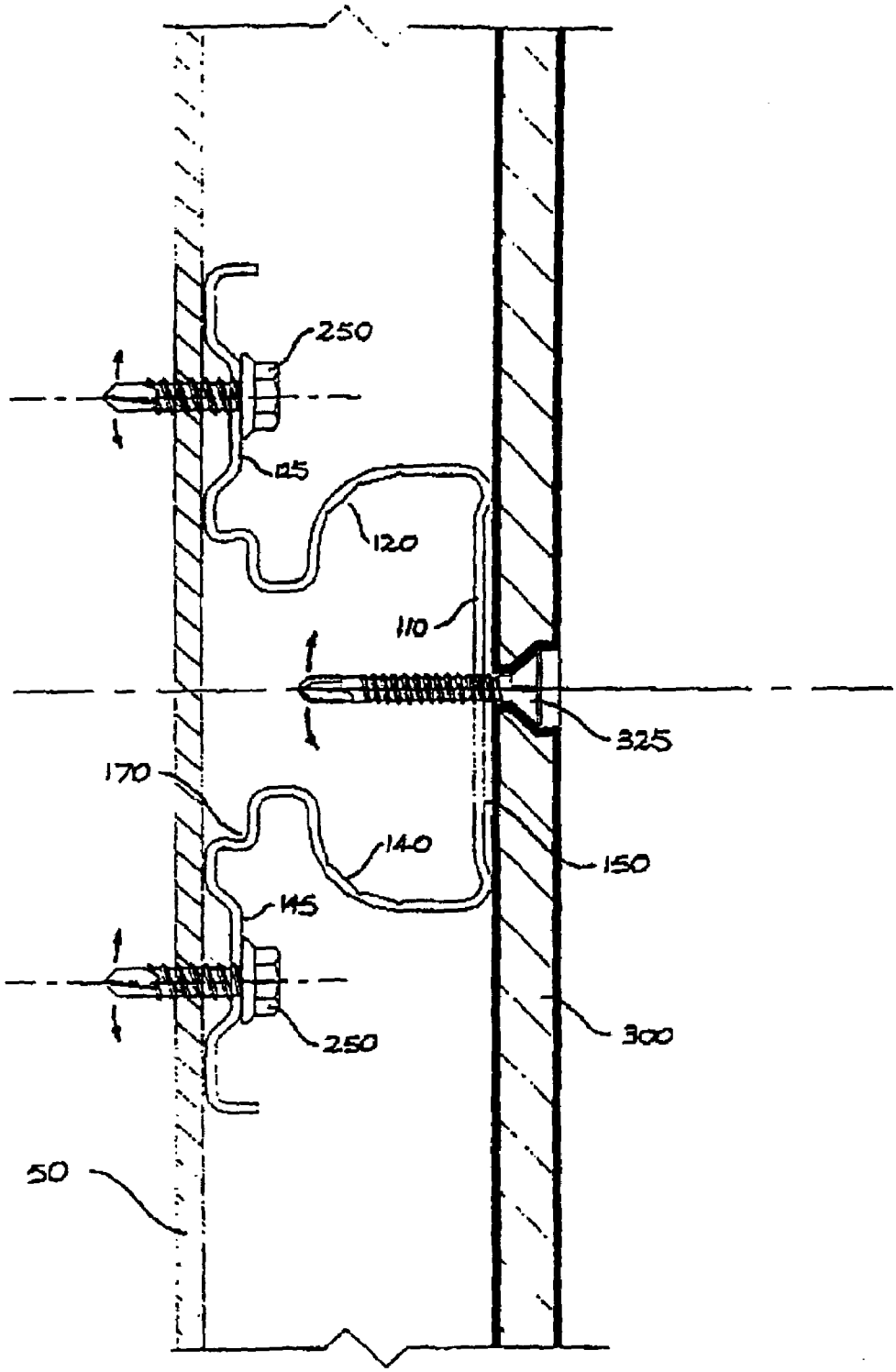
FIG. 11 shows the top hat batten of FIG. 10 in the reverse orientation.

An alternative batten is shown in FIG. 10 (normal orientation) and FIG. 11 (reverse orientation), where corresponding features are denoted by like reference numerals. This batten functions in essentially the same way as that previously described, but is more Ω-shaped in cross sectional profile, and so will exhibit different deformational characteristics.

Figure 2:
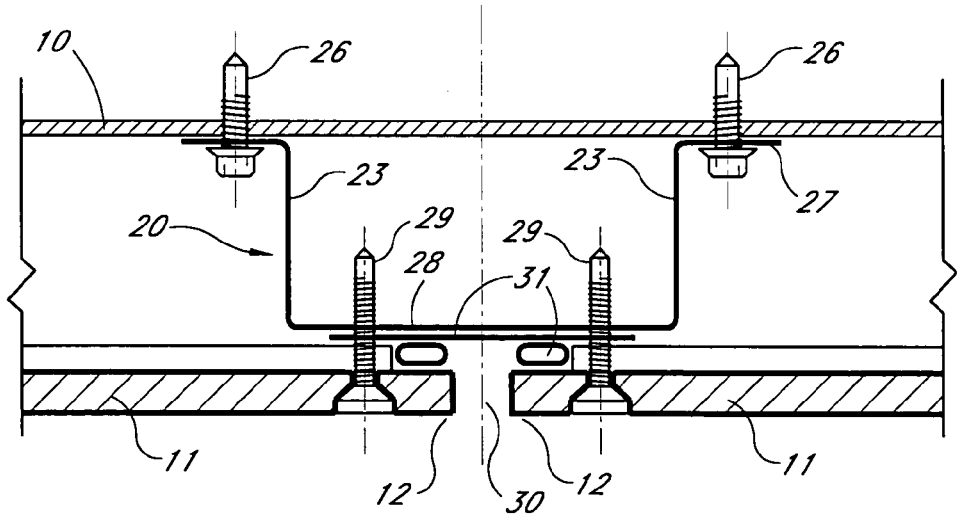
FIG. 2 (PRIOR ART)

As will be clear to those skilled in the art, the battens 100 according to the present invention provide substantial advantages over the conventional prior art batten shown in FIG. 2. Firstly, the fact that the batten may be fixed to the frame or wall by a single row of fasteners 250 as has already been discussed. The batten 100 also provides that the spacing between fasteners 325 on adjacent cladding sheets is much greater than that allowed by conventional techniques, as will be apparent from FIG. 2. By spacing the fasteners 325 further apart and further from the edges of the respective cladding sheets, the possibility for fracture or break out of a sheet 300 along the line of the fasteners is greatly reduced.

In addition to the above, the side walls 120 and 140 of the batten 100 are configured to deform preferentially over the cladding sheets, as a result of stress applied to or by the sheets. More particularly, the dimensions of cladding sheets such as fibre reinforced cement cladding sheets may alter over time. Some FRC sheets, for example, can expand or shrink due to moisture, carbonation etc. When the cladding sheet 300 shrinks, stress is applied to the edges 310 of the sheets via its connection with the supporting batten and frame. With known battens, this shrinkage can be sufficient to cause deformation, cracking or even failure of the cladding sheet 300 at its edges or elsewhere.

The present invention overcomes this problem by configuring the batten 100 to yield to such as applied stress in preference to deformation or failure of the cladding sheets 300. When the cladding sheets shrink, for example, the sides 120 and 140 of the supporting battens 100 would deform outwardly in response.

Similar deformation would result from external stresses. For example, the battens 100 will preferably yield to thermal expansion of frame or wall 50, wind loading, or the like within certain tolerances, thereby substantially isolating the cladding sheets from such stresses.

As shown in the drawings, it is also preferable that the cladding sheets 300 are connected directly to the battens 100 without packing, gaskets or the like. This saves material costs, reduces labour time, and avoids possible difficulties with over tightening the fastening screws. When connecting the cladding sheet to the batten by screwing, once the cladding sheet sits squarely on the flanges 125 and 145 no further tightening of the screws 325 is required. This contrasts with the prior art as shown in FIG. 2, whereby due to packing, sealing gaskets and the like between the sheet and the batten, over tightening of the screw fasteners can occur.

The preferred configurations shown in FIGS. 4 to 11 also have several advantages in terms of weatherproofing. During installation, and referring particularly to FIG. 6, the sealing strip 200 is initially spring fitted into the mutually opposing grooves 170 formed in the shoulders of the batten 100. In this position, the sealing strip 200 stands proud of the flanges 125 and 145. The cladding sheets 300 are then screwed into position thereby providing primary contact seals 122 and 142 where the sealing strip 200 contacts the back of each cladding sheet 300.

Such a configuration also provides two pressure equalized drainage channels 123 and 143 on either side of the sealing strip. Any moisture which does manage to migrate past the primary contact seals 122 and 142 can drain through the adjacent drainage channels. Further pairs of secondary contact seals 124 and 144 are provided by the corresponding flange portions 125 and 145 contacting the respective cladding sheets. In between these secondary pairs of contact seals, respective secondary drainage channels 126 and 146 are provided in much the same fashion as drainage channels 123 and 143.

It will there be clear to those skilled in the art that not only does the inventive batten 100 remove the need for additional packing, gaskets, and the like to provide a weatherproof seal, it does not rely only on one contact region to provide a weatherproof seal. Rather, it provides a series of primary and secondary contact seals with drainage channels disposed therebetween to virtually eliminate the prospect of moisture migrating behind the cladding sheets. It should also be recognised that the batten 100 provides a much simpler mechanism for installation over the conventional system shown in FIG. 2 which requires the provision and alignment of various packing and gasket materials.

A further advantage of the present invention relates to the ability of the batten 100 to permit movement of the fastening screws relative to the cladding sheets. As shown most clearly in FIGS. 6, 9 and 10, each of the fasteners 325 along the sheet edges 310 extends through one of the recessed grooves or drainage channels 126/146 provided on flange portions 125/145 of the adjacent batten. By locating these fasteners 325 in the recessed grooves where the back of the cladding sheet is not in direct contact with the flanges, the fasteners 325 have the ability to tilt or pivot and thereby accommodate some lateral movement of the sheet relative to the batten in both the vertical and horizontal directions. Thus, if the sheet shrinks, the exterior portion of the fastener screw is drawn towards the center of the sheet. If the sheet is in direct contact with the batten flange, no significant pivoting of the screw can occur, as is the case in the prior art. With the present invention, however, the fastener can tilt or pivot about its contact point with the flange, thereby to accommodate a limited degree of relative displacement between adjacent sheets and between the sheets and the battens in two dimensions, in response to the applied stress.

Figure 8:
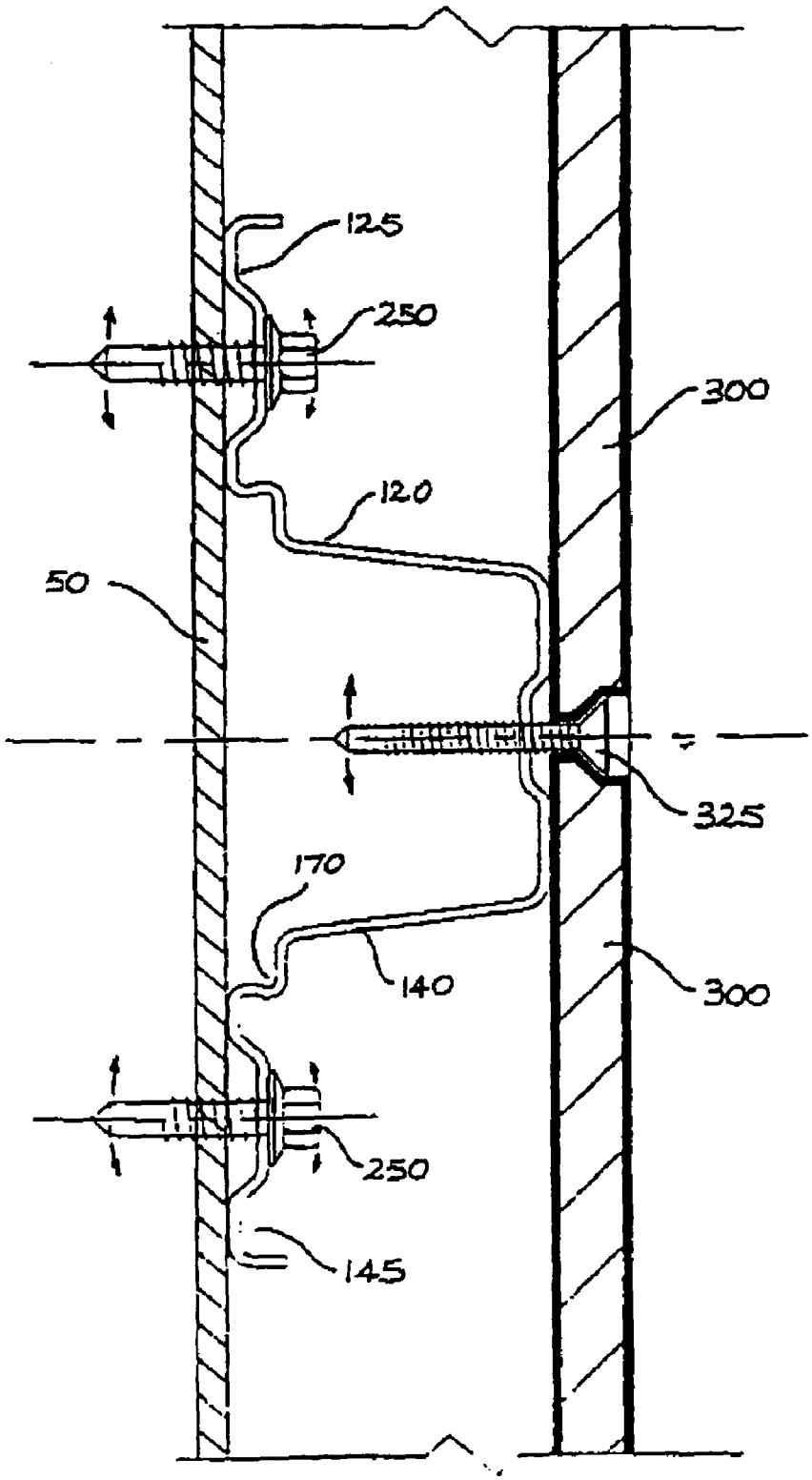
FIG. 8 is a cross sectional view showing the top hat batten located in reverse orientation to support intermediate or internal area of the cladding sheet.
Figure 9:
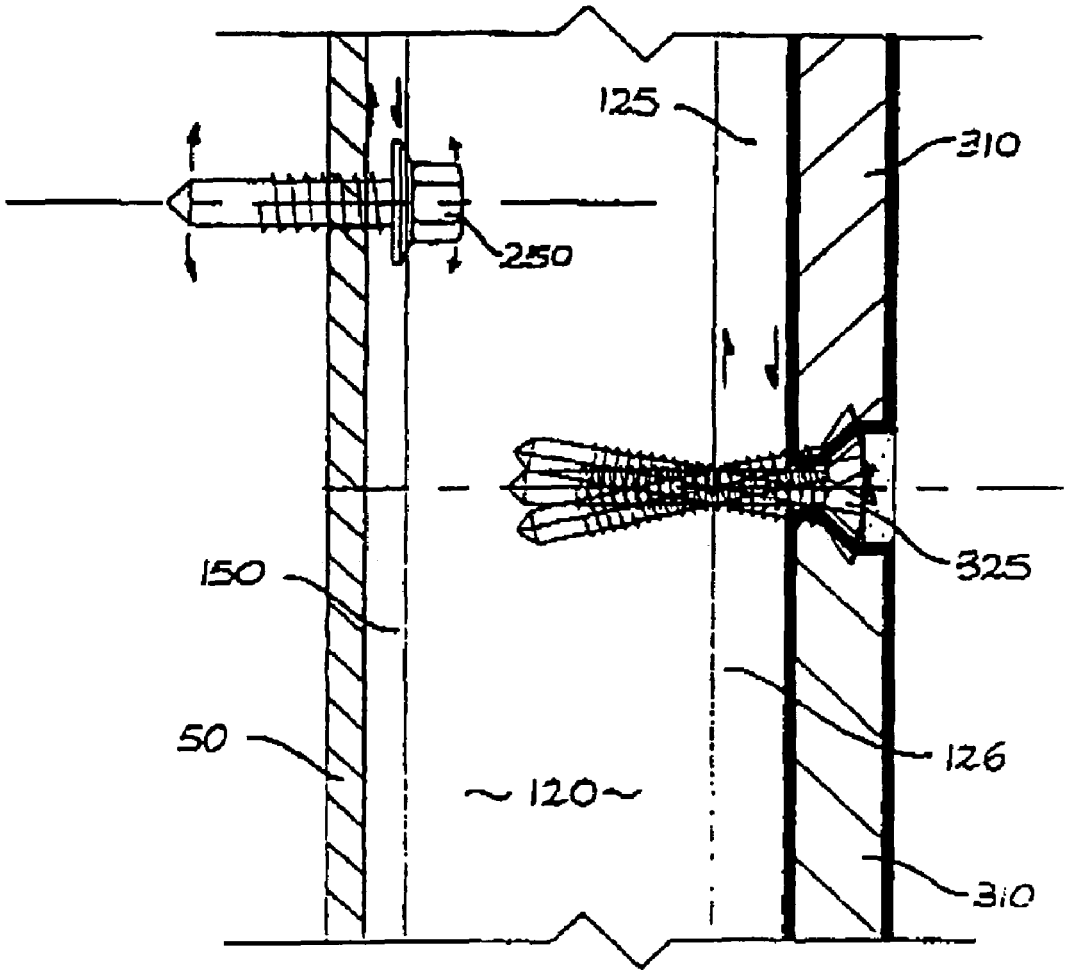
FIG. 9 is a longitudinal sectional view taken vertically through the batten of FIG. 6, showing pivotal movement of the mounting screws in the flange in the vertical plane.

It will be also noted that the web of the batten incorporates a similar longitudinal recess or groove 150, which functions in an analogous manner to allow pivoting of the associated fastening screws extending therethrough. This is particularly advantageous in the case of those battens installed in intermediate locations in the reverse orientation, as shown in FIGS. 8 and 11, but is also beneficial in the normal orientation by permitting pivotal movement of the screws fastening the web of the batten to the wall or frame (see FIGS. 6, 9 and 10).

It will be appreciated that by varying the gauge thickness, by using a higher or lower strength material, by using different materials, or by altering the cross sectional profile, the battens can be specifically tailored to match the stresses expected to be applied by or to the cladding sheets. Further, the shape of the recessed fixing grooves and drainage channels 126/146 may be altered such that the batten can accommodate additional shrinkage or swelling of the cladding sheet. In all these respects, the invention represents a practical and commercially significant improvement over the prior art.

Although the invention has been described with reference to specific examples, it will be appreciated by those skilled in the art that the invention may be embodied in many other forms. In particular, the sealing strips and battens can be constructed from any suitable materials including metal or plastic. Moreover, the battens can be configured to deform elastically or plastically depending upon requirements.

The invention claimed is:

1. A method for mounting cladding sheets to a wall or frame, said method comprising:

providing a plurality of battens wherein each batten has an elongate channel member having a pair of spaced apart walls joined by an intermediate web, and a pair of mounting flanges spaced generally parallel to the web and extending laterally from the side walls, the web being adapted for connection either to the wall or frame or alternatively to the cladding sheets, and the flanges being adapted for connection either to the cladding sheets or the wall or frame by fastening elements, wherein at least one of the flanges includes a longitudinally extending recessed channel configured to provide a clearance space between the cladding sheet and a portion of the mounting flange such that a limited degree of relative lateral displacement between the cladding sheet and the batten is allowed by pivotal movement of the fastening elements, and further having a longitudinally extending recessed channel along the web to permit a limited degree of lateral displacement in two dimensions between the batten and the wall or frame by pivotal movement of fastening element extending through the web;

positioning a plurality of said battens in spaced apart generally parallel relationship by securing the web of each batten to the wall or frame by fastening screws, and securing the longitudinal edges of each cladding sheet to the respective mounting flanges of the battens by fastening screws, such that stress applied to the cladding sheets is accommodated by said pivotal movement of the fastening elements and said relative lateral displacement between the cladding sheets and the battens.

2. The method according to claim 1, further comprising positioning selected battens in intermediate positions between the outer edges of the sheets to provide internal support for the sheets.

3. The method according to claim 2, wherein at least some of the intermediate battens are fastened in a reverse orientation, wherein the flanges are connected to the frame or the wall, and the cladding sheet is connected to the web.

4. The method according to claim 3, wherein the web includes a longitudinally extending recessed channel, being configured in the normal orientation to provide a clearance space between the wall or frame and the web, and in the reverse orientation to provide a clearance space between the cladding sheet and the web.

5. The method according to claim 4, wherein the web channel is configured to accommodate a limited degree of pivotal movement of the fastening elements extending through the web, thereby to permit a limited degree of relative lateral displacement in two dimensions between the cladding sheet and the batten in the reverse orientation.

6. The method according to claim 1, wherein the batten is configured such that the force required to displace of the side walls is less that which would normally induce failure in the cladding sheets due to expected movement or contraction in situ as a result of changes in moisture content.

7. A batten assembly for mounting cladding sheets to a wall or frame, said assembly comprising:

a batten having a web, two outwardly extending and diverging side walls, and a pair of mounting flanges extending laterally from the side walls, the mounting flanges generally parallel to the web; and a sealing strip, the batten further configured with a pair of inwardly depending mutually opposed substantially parallel retaining grooves, the sealing strip including complementary longitudinal edge formations adapted to be captively retained within the respective grooves whereby the sealing strip substantially covers an open channel section of the channel member.

8. The batten assembly according to claim 7, wherein each of the retaining grooves is disposed in a shoulder region, formed between a respective one of the side walls and an associated one of the flanges on a corresponding side of the channel member.

9. The batten assembly according to claim 7, wherein the longitudinal edge formations of the strip are adapted for sealing engagement with the respective retaining grooves, to resist ingress of moisture into the open channel section of the channel member.

10. The batten assembly according to claim 7, wherein the longitudinal edge formations and the respective retaining grooves are configured to provide releasable snap locking engagement between the channel member and the sealing strip, accommodated by resilient deformation of the side walls or the intermediate web in response to installation pressure applied to the sealing strip.

11. The batten assembly according to claim 7, wherein the sealing strip is formed from sheet material, and wherein the longitudinal edge formations are formed by folding respective longitudinal edges of the sheet material.

12. The batten assembly according to claim 7, wherein the sealing strip is adapted, in situ, to stand marginally proud of the flanges of the channel member, to provide primary contact seals upon engagement with a mounted cladding sheet.

13. The batten assembly according to claim 12, wherein the respective flange portions of the channel member include raised regions adapted to provide secondary contact seals upon engagement with a mounted cladding sheet.

14. The batten assembly according to claim 13, wherein the channel member and the sealing strip are configured to define longitudinal primary drainage channels on either side of the batten, between the respective primary and secondary contact seals.

15. The batten assembly according to claim 14, wherein the recessed channels formed in the mounting flanges define respective secondary drainage channels, disposed outwardly of the corresponding primary drainage channels.

16. A method of mounting cladding sheets to a wall or frame, said method comprising:

providing a plurality of battens, each comprising an elongate channel member having a pair of spaced apart sides walls joined by an intermediate web and a corresponding pair of mounting flanges spaced outwardly from the web and extending laterally from the side walls;

fastening the battens to a wall or frame in a generally spaced apart relationship by fastening the web of each one of said plurality of battens to said wall or frame; and fastening the mounting flanges of each one of said plurality of battens to abutting longitudinal edges of said cladding sheets.

17. The method according to claim 16, wherein the web of each said batten have a longitudinally extending recessed channel being configured to provide a clearance space between the wall or frame and a corresponding portion of the respective web.

18. The method according to claim 17, further comprising fastening the web to the wall or frame with fastening elements, the web channel being configured to accommodate a limited degree of pivotal movement of the fastening elements extending through the web, thereby to permit a limited degree of relative lateral displacement in two dimensions between the wall or frame and the batten.

19. The method according to claim 16, wherein the mounting flanges of each said batten have a longitudinally extending recessed channel being configured to provide a clearance space between the cladding sheets and a corresponding portion of the respective mounting flanges.

20. The method according to claim 19, further comprising fastening the mounting flanges to the cladding sheets with fastening elements, the longitudinally channel of the mounting flanges being configured to accommodate a limited degree of pivotal movement of the fastening elements extending through the mounting flanges, thereby to permit a limited degree of relative lateral displacement in two dimensions between the cladding sheets and the batten.

21. A system for mounting cladding sheets to a wall or frame, said system comprising:

one or more cladding sheets; and a batten comprising an elongate channel member having a pair of spaced apart side walls joined by an intermediate web, and a corresponding pair of mounting flanges spaced outwardly from the web and extending laterally from the side walls, one of the web and the pair of flanges being adapted for connection to the wall or frame and the other of the web and the pair of flanges being adapted for connection to the cladding sheets, wherein the batten comprises at least two deformable portions, each deformable portion being deformable independently of the other deformable portion, each deformable portion being adapted for connection to a corresponding one of the cladding sheets, and each deformable portion being deformable more easily than the corresponding cladding sheets.

22. The system according to claim 21, wherein the at least two deformable portions are adapted so that one or more loads applied to the one or more cladding sheets initially result in deformation of deformable portions of the batten being generally greater than deformation of a portion of the one or more cladding sheets connected to the batten.

23. The system according to claim 22, wherein the load derives from at least one of an applied force and a change in size of the one or more cladding sheets, wherein the change in size is caused by at least one of a change in temperature, a change in moisture content, and carbonation of the one or more cladding sheets.

24. The system according to claim 21, wherein said web is adapted for connection to the wall or frame.

25. The system according to claim 21, wherein said flanges are adapted for connection to said one or more cladding sheets.

26. The system to claim 21, wherein the force required to displace one of the side walls of the batten is less than that which would normally induce failure in a cladding sheet due to expected movement or contraction as a result of changes in moisture content.

27. The system according to claim 21, wherein the batten is tailored to cladding sheets of preselected characteristics, to induce a predetermined degree of flexural deformation in the side walls according to the stresses normally expected to be applied.

28. The system according to claim 21, wherein the channel is generally U-shaped.

29. The system according to claim 21, wherein the channel is generally Ω-shaped.

30. The system according to claim 21, wherein the channel is generally V-shaped.

31. The system according to claim 21, wherein the side walls diverge outwardly from the web toward the mounting flanges.

32. The system according to claim 21, wherein the flanges are adapted for connection to said one or more cladding sheets by means of discrete fastening elements.

33. The system according to claim 32, wherein said discrete fastening elements comprise self-tapping screws.

34. The system according to claim 33, wherein the mounting flanges include respective longitudinally extending recessed channels configured to provide a clearance space between one or more cladding sheets and corresponding portions of the mounting flanges.

35. The system according to claim 34, wherein the screws are adapted to extend through the clearance spaces, so as to accommodate a limited degree of pivotal movement between the screws and the flanges, thereby permitting a limited degree of relative lateral displacement in two dimensions between a cladding sheet and the batten, in the plane of the sheet.

36. The system according to claim 35, wherein the recessed channels are configured to facilitate drainage and thereby impede water ingress in adverse weather conditions.

37. The system according to claim 34, wherein the web includes a longitudinally extending recessed channel configured to provide a clearance space between the wall or frame and a corresponding portion of the web, said clearance space being adapted to accommodate a limited degree of pivotal movement of said discrete fastening elements extending through the web, thereby to permit a limited degree of relative lateral displacement in two dimensions between the batten and the wall or frame, independently of relative displacement accommodated by deformation of the side walls.

38. The system according to claim 21, wherein the batten is formed from sheet metal having overall dimensions, thickness, and material composition selected to provide the batten with predetermined deformation characteristics.

39. The system according to claim 21, wherein the batten includes a pair of inwardly depending mutually opposed substantially parallel retaining grooves.

40. The system according to claim 39, further including a sealing strip having complementary longitudinal edge formations adapted respectively to be captively retained within said retaining grooves whereby the sealing strip substantially covers an open channel section of the channel member.

41. The system according to claim 40, wherein each of the retaining grooves is disposed in a shoulder region formed between a respective one of the side walls and an associated one of the flanges on a corresponding side of the channel member.

42. The system according to claim 40, wherein the longitudinal edge formations of the strip are adapted for sealing engagement with the respective retaining grooves to resist ingress of moisture into the open channel section of the channel member.

43. The system according to claim 40, wherein the longitudinal edge formations and the respective retaining grooves are configured to provide releasable snap locking engagement between the channel member and the sealing strip, accommodated by resilient deformation of the side walls or the intermediate web in response to installation pressure applied to the sealing strip.

44. The system according to claim 40, wherein the sealing strip is formed from sheet material, and wherein the longitudinal edge formations are formed by folding respective longitudinal edges of the sheet material.

45. The system according to claim 40, wherein the sealing strip is adapted, in situ, to stand marginally proud of the flanges of the channel member to provide primary contact seals upon engagement with a mounted cladding sheet.

46. The system according to claim 45, wherein the respective flange portions of the channel member include raised regions adapted to provide secondary contact seals upon engagement with a mounted cladding sheet.

47. The system according to claim 46, wherein the channel member and the sealing strip are configured to define longitudinal primary drainage channels on either side of the batten and between the respective primary and secondary contact seals.

48. The system according to claim 47, wherein the recessed channels formed in the mounting flanges define respective secondary drainage channels disposed outwardly of the corresponding primary drainage channels.

49. The system according to claim 21, wherein the deformable portions are located respectively between the web and the mounting flanges.

50. The system according to claim 49, wherein the deformable portions comprise the side walls.

51. The system according to claim 21, wherein said deformation is substantially elastic in mode.

52. The system according to claim 21, wherein said deformation is at least partially plastic in mode.

53. A method of mounting cladding sheets to a wall or frame, said method comprising:

providing a plurality of battens each comprising an elongate channel member having a pair of spaced apart side walls joined by an intermediate web, at least two deformable portions, and a corresponding pair of mounting flanges spaced outwardly from the web and extending laterally from the side walls, one of the web and the pair of flanges being adapted for connection to the wall or frame and the other of the web and the pair of flanges being adapted for connection to one or more cladding sheets;

fastening one of the web and the pair of flanges of each of said battens to said wall or frame; and fastening the other of the web and the pair of flanges of each of said battens to one or more cladding sheets; wherein each deformable portion is deformable independently of the other deformable portion, each deformable portion being adapted for connection to a corresponding one of the cladding sheets, and each deformable portion being deformable more easily than the corresponding cladding sheets.

54. The method according to claim 53, wherein the web of each of said battens is connected to said wall or frame and the mounting flanges of each of said battens are connected to said cladding sheets.

55. The method according to claim 54, wherein the mounting flanges of each of the battens have respective longitudinally extending recessed channels configured to provide a clearance space between the cladding sheets and corresponding portions of the mounting flanges.

56. The method according to claim 55, wherein the web of each of the battens have a longitudinally extending recessed channel configured to provide a clearance space between the wall or frame and a corresponding portion of the web.

57. The method according to claim 56, further comprising fastening the flanges of each of said battens to the cladding sheets by means of discrete fastening elements.

58. The method according to claim 57, further comprising fastening the web of each of said battens to the wall or frame by means of discrete fastening elements.

59. The method according to claim 58, wherein the fastening elements are adapted to extend through the clearance spaces, so as to allow a limited degree of pivotal movement between the fastening elements and the respective wall or frame or mounting flanges, thereby permitting a limited degree of relative lateral displacement in two dimensions between the cladding sheet and the batten, in the plane of the cladding sheet.

60. The method according to claim 53, wherein the at least two deformable portions are located respectively between the web and the mounting flanges.

61. The system according to claim 60, wherein the at least two deformable portions comprise the side walls.

62. The method according to claim 53, wherein said deformation is substantially elastic in mode.

63. The method according to claim 53, wherein said deformation is at least partially plastic in mode.

* * * * *